United States Patent [19]

Cassou

[11] 3,965,649

[45] June 29, 1976

[54] APPARATUS FOR GROUPING ARTIFICIAL INSEMINATION STRAWS

[76] Inventor: Maurice Jean-Pierre Cassou, 61300 La Sapaie Saint-Symphorien des Bruyeres-par-l'Aigle, France

[22] Filed: Feb. 13, 1975

[21] Appl. No.: 549,796

[30] Foreign Application Priority Data

Feb. 15, 1974 France ..... 74.05287

[52] U.S. Cl. ..... 53/127; 53/236

[51] Int. Cl.[2] ..... B65B 5/10

[58] Field of Search ..... 53/74, 142, 148, 127, 53/236, 252

[56] References Cited

UNITED STATES PATENTS

| | | | |
|---|---|---|---|
| 1,825,058 | 9/1931 | Goldstein et al. | 53/252 |
| 2,624,165 | 1/1953 | Gamble | 53/148 |
| 2,753,267 | 7/1956 | Rabin et al. | 53/236 X |
| 3,535,847 | 11/1970 | Strohmeier et al. | 53/236 X |

*Primary Examiner*—Robert L. Spruill
*Attorney, Agent, or Firm*—Wenderoth, Lind & Ponack

[57] ABSTRACT

The apparatus comprises a container feed device feeding containers one-by-one to a filling station in which station the filling opening of the container is contained in a vertical plane. An artificial insemination straw feed device feeds straws one-by-one to the filling station in a horizontal position in which the straw is perpendicular to said plane and disposed in front of the opening in a space adjacent to said plane and on the side of said plane opposed to the container. A charging device shifts the straws one-by-one longitudinally of the straw to a position inside the container at the filling station. The apparatus is particularly advantageous for grouping straws in containers in the form of test-tubes inside a cryogenic vessel.

11 Claims, 7 Drawing Figures

APPARATUS FOR GROUPING ARTIFICIAL INSEMINATION STRAWS

BACKGROUND OF THE INVENTION

The present invention relates to an apparatus for grouping artificial insemination straws.

It is known that artificial insemination establishments must store for many years, before utilization, considerable amounts of reproducing bull semen during the time required to ascertain the improving qualities of the race of the bulls on a small number of their descendants called "test animals".

During this time the storage is carried out by doses in elongated cylindrical straws of standard diameters, for example 2 or 3 mm. It can occur that insemination establishments, which distribute only a few hundreds of thousands of doses annually, have several millions of doses in stock. Indeed, the race-improving quality of a bull is only known several years after his death and usually only one animal in ten has this quality, the doses coming from all the others being then destroyed.

The storage is carried out usually by grouping the straws in containers having a generally cylindrical shape such as test-tubes or cases which may contain 200 to 850 straws for example. The straws grouped in this way and previously deep-frozen are then conserved inside cryogenic vessels which contain nitrogen at about −196°C and are assembled in special buildings.

The straws, crystallized by the cold, are consequently extremely fragile and this is why an object of the present invention is to provide an apparatus for grouping such straws without damaging them.

SUMMARY OF THE INVENTION

According to the invention, there is provided an apparatus for grouping artificial insemination straws comprising a device for feeding containers to a filling station where the filling opening of the containers is vertical, a device for feeding the straws one-by-one to a horizontal charging position in which the straw is oriented in a direction perpendicular to the plane of the opening of the container which is at the filling station and is disposed in a half-space which is defined by the plane of said opening and does not contain the container, and in front of said opening, and a charging device for shifting the straws one-by-one in a direction parallel to their length from said position to a position inside the container.

For the same reason, in a particularly advantageous embodiment of the invention, it is arranged that, in the case of the grouping of straws in containers whose length is less than the length of said straws, the straw feeding device comprises a straw supply means for supplying straws one-by-one in an intermediate horizontal position in which the straw is oriented in a direction parallel to the charging position but below the lowermost level of the opening of the container, and an intermediate shifting device for shifting the straws one-by-one in a direction perpendicular to their length from said intermediate position to the charging position which is disposed above said lowermost level of the opening and interferes with the position of the lowermost straw in the container.

As the storage potential of a vessel is much greater when the straws are grouped in test-tubes of large diameter, the storage is usually effected in such test-tubes. On the other hand, when they are to be used by the operators in charge of the artificial insemination, the distribution of the doses requires that the straws be re-grouped in a smaller number in test-tubes of smaller diameter. The storage in large test-tubes is particularly economic as it reduces to a minimum the amount of nitrogen, the number of vessels and even the space consumed in the buildings.

However, it sometimes happens that whereas the initial grouping in large test-tubes can be effected in the vessel without special apparatus, the second grouping in small test-tubes for transportation must be carried by means of a more precise apparatus, of the aforementioned type.

Thus, in this particularly advantageous application of the invention, the grouping apparatus may comprise a chassis below which the various devices are suspended, this chassis also carrying drive means and transmission means between the drive means and said devices. Thus, by placing the chassis on the opening of the vessel, the operation for grouping the straws in test-tubes can be carried out as near as possible to the level of the nitrogen and therefore in a very cold zone, whereas the control and drive means are located at a distance from this level in a warm zone.

Also according to the invention, the various devices of this apparatus are preferably suspended below a chassis which bears on the opening of a cryogenic vessel so as to be located just above the level of the coolant fluid contained in the vessel.

BRIEF DESCRIPTION OF THE DRAWINGS

Further features and advantages of the invention will be apparent from the ensuing description, given by way of example, with reference to the accompanying drawings in which.

DETAILED DESCRIPTION OF THE INVENTION

Figure 2:
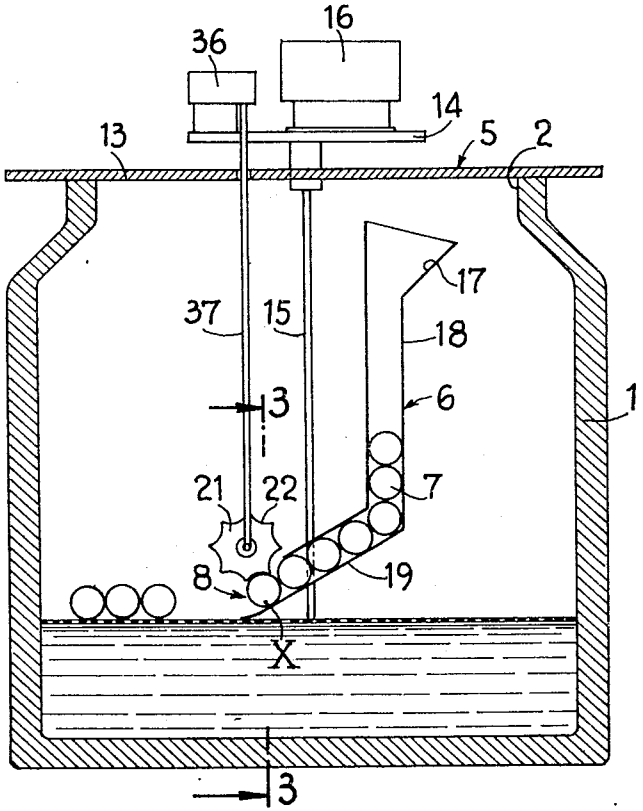
FIG. 2 is a similar sectional view taken on line 2—2 of FIG. 3 of the test-tube feeding device.
Figure 1:
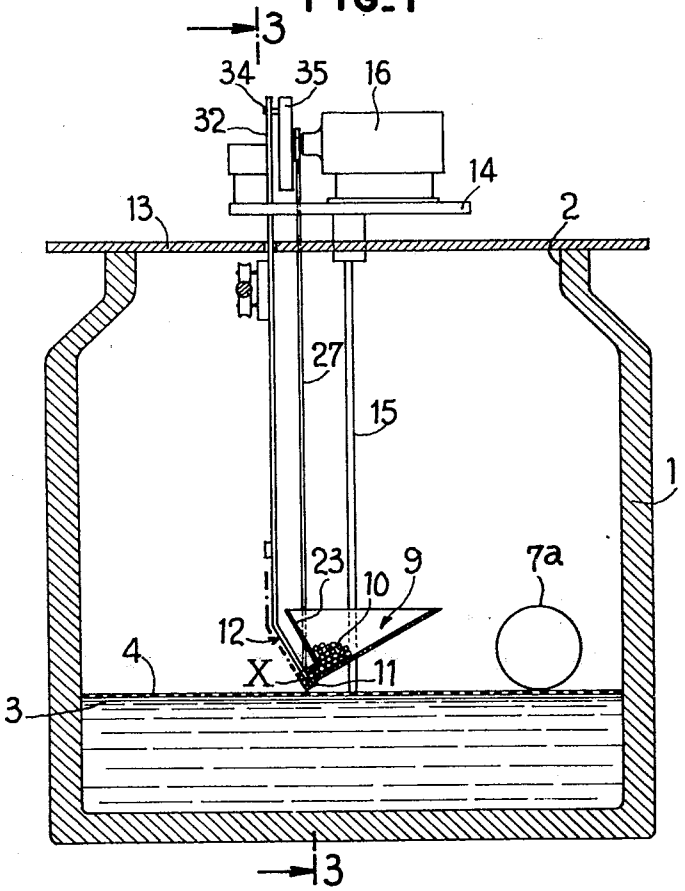
FIG. 1 is a vertical sectional view of a cryogenic vessel for storing artificial insemination straws in test-tubes, equipped with a grouping apparatus according to the invention, this section being taken on line 1—1 of FIG. 3 and showing the straw supply device.

The cryogenic vessel 1 shown in FIGS. 1 and 2 has a generally cylindrical shape and a vertical axis and defines a circular opening 2 in its upper part. This vessel is filled with nitrogen at −196°C up to a level 3 slightly above which there is disposed a horizontal work grid 4.

The grouping apparatus with which this vessel is equipped comprises a chassis 5 from which are suspended a device 6 for feeding test-tubes 7 to a filling or charging station 8, a device 9 for feeding straws 10 one by one, and two devices 11 and 12 for shifting said straws to the filling station 8.

The chassis 5 comprises a horizontal support 13 which bears against the periphery of the opening 2 of the vessel. This support supports, above the support, a horizontal table 14 and, extending below the support inside the vessel on the axis of the latter, a vertical support 15. The horizontal table 14 supports a drive motor 16 having a horizontal output shaft.

Figure 3:
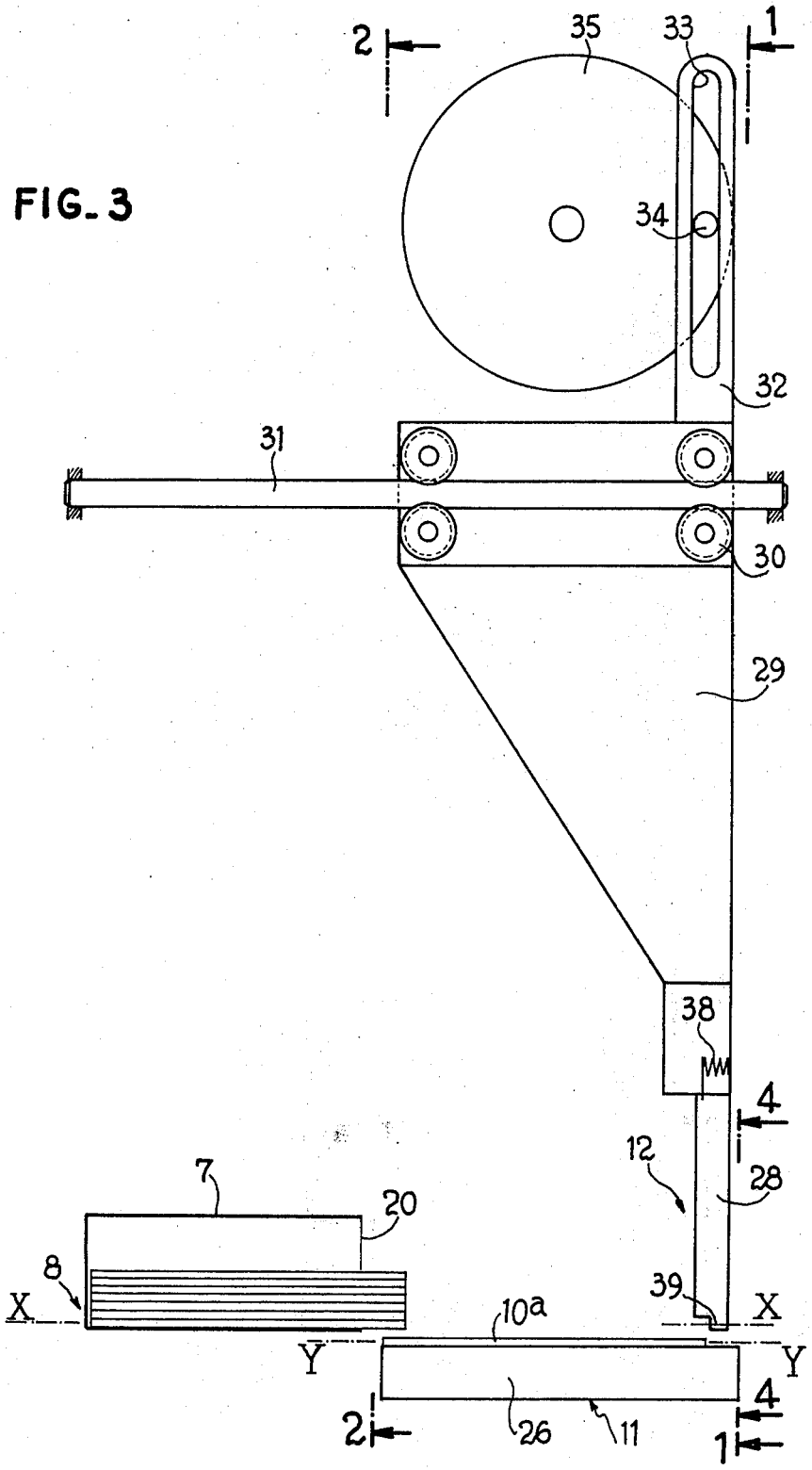
FIG. 3 is a diagrammatic and partial sectional view to an enlarged scale and taken on line 3—3 of FIGS. 1 and 2 of the two straw-shifting devices, the assembly being in the initial position of a charging operation.

The filling station 8 is embodied in the Figures by a horizontal line X—X and is disposed slightly above the level of the grid 4, this line X—X being perpendicular to the plane of FIGS. 1 and 2 and in the plane of FIG. 3. This line corresponds to the direction of movement of a straw at the end of the charging operation into a test-tube.

The device 6 for feeding the test-tubes 7 to the filling station 8 comprises in succession a hopper 17 disposed in the vicinity of the opening of the vessel, a vertical chute 18 and an inclined chute 19 which extends the chute 18 to the station 8. This hopper and these chutes are supported by the vertical support 15. The cross-section of the chutes is such that, in starting from the hopper, the test-tubes 7 are capable of descending therein in succession one behind the other with their axes horizontal (these test-tubes being cylindrical) and with their openings 20 all facing in the same direction, namely in the direction of the straw feeding device 9.

The device 6 for feeding the test-tubes further comprises a barrel or drum 21 having recesses 22 disposed with its axis horizontal above the filling station 8, this drum also being suspended from the chassis 5. This drum has a number of peripheral recesses 22 whose shape partially matches the contour of a test-tube 7, each recess 22 being capable of placing itself, by rotation of the drum, in succession at the filling station 8 so as to maintain in position at this station a test-tube 7 between a recess and the bottom of the chute 19.

The device 9 for feeding straws one by one comprises a hopper 23 disposed slightly above the level of the grid 4 and suspended from the vertical support 15. The bottom of the hopper communicates with an inclined passageway 24 which opens into another inclined passageway 25 perpendicular to the passageway 24. These two passageways are defined by walls secured to the hopper and the cross-section of each passageway corresponds approximately to the dimensions of a straw 10 which is disposed horizontally, these two passageways intersecting on a mean line Y—Y which is disposed horizontally and a short distance below the line X—X which is located in the passageway 25 but above the line Y—Y. The position of a straw 10*a* along the line Y-Y after having passed through the passageway 24 constitutes the first position of the straw in its positioning for charging into a test-tube.

The first device 11 for shifting the straws from the position 10*a* toward the line X-X comprises a rigid horizontal bar 26 having the same cross-section as the passageway 25 and mounted to slide in the latter from the level of the extreme end of the passageway 24 to above this end. This bar 26 is connected to the motor 16 by a transmission diagrammatically represented by the line 27 and constituted by a conventional linkage controlled for example by a cam driven by the motor.

The second device 12 for shifting the straws comprises a vertical arm 28 whose lower end is cranked and disposed to slide horizontally in the passageway 25 at the level of the line X—X. This vertical arm is suspended from a carriage 29 which is capable of moving in translation, owing to the provision of rollers 30, on a horizontal bar 31 fixed to the chassis 5 and disposed in a direction parallel to the line X—X below the level of the support 13 of the chassis. This carriage 29 carries in its upper part a vertical arm 32 which receives a pin 34 extending from the peripheral portion of a disc 35 which is mounted and centered on the horizontal output shaft of the motor 15, the pin 34 being parallel to this shaft. The relative disposition of the axis of the disc 35 and the transverse overall size of the passageway 25 in the direction of the line Y—Y is such that when the pin 34 of the disc effects a complete revolution, the carriage 29 moves in a to-and-fro movement which shifts the arm 28 between the two ends of the passageway 25.

FIG. 3 shows a position in which the arm 28 is disposed at the end of the passageway 25 remote from the filling station 8. FIG. 3 also shows that this filling station 8 is parallel to, and slightly to the rear of the shifting device 11 which comprises the bar 26.

The apparatus also comprises an electronic counter 36 which is disposed on the table 14 and records the number of displacements effected by the carriage 29. This counter is connected to a drive element 37 in such a manner as to trigger or actuate it. The element 37 is adapted to advance the drum 21 through one rotational step upon each actuation. The arm 28 is pivotally mounted on the carriage 29 by an escape spring 38 which allows this arm to retract when it is subjected to a certain limit force in the direction opposed to the filling station 8.

The apparatus just described operates in the following manner.

Figure 4:
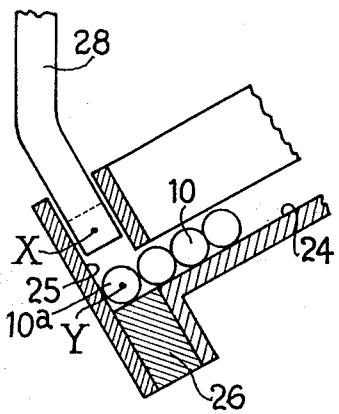
FIG. 4 is a detail sectional view of the shifting devices taken on line 4—4 of FIG. 3.

The hopper 17 is filled with test-tubes so that the openings 20 of the test-tubes which arrive in succession at the filling station 8 are facing in the same direction, namely in the direction of the arm 28. One of the recesses 22 of the drum 21 maintains one of the test-tubes in such a position. The hopper 23 is also filled with straws which assume a horizontal position one behind the other in the passageway 24, the first of these straws being placed on the line Y-Y at the intersection of the passageways 24 and 25 and on the bar 26, as shown in FIG. 4.

Figure 7:
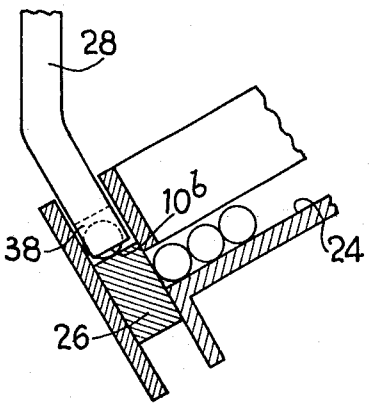
FIG. 7 is a sectional view, similar to FIG. 4, taken on line 7—7 of FIG. 5.

The raising of the bar 26, periodically produced by the motor 16, shifts the straw which bears thereon from the first position 10*a* to a second higher position 10*b* in the passageway 25 on the line X—X. In this second position shown in FIG. 7, the lower end of the arm 28, which has for this purpose a shoulder 39, is disposed behind the end of the straw opposed to the test-tube 7 which is positioned at the filling station 8, this position being shown in FIGS. 5 and 7.

Figure 5:
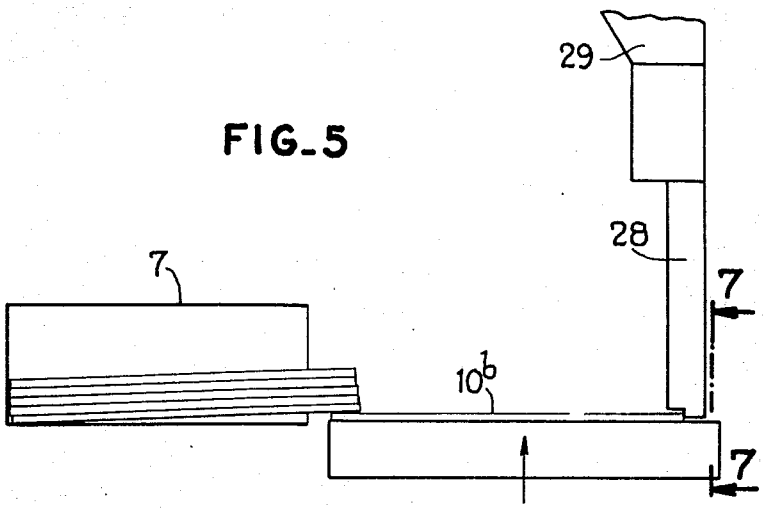
FIGS. 5 and 6 are partial views, similar to FIG. 2, of the devices respectively after the first displacement and during the second displacement of the straws.

As also shown in FIG. 5, in its rising movement, the straw 10 raised by the bar 26 encounters the straws already deposited in the test-tube. Indeed, the dimensions of the test-tube are so arranged that the straws extend out of the test-tube to a certain extent, the straws being for example 133 mm in length whereas the test-tubes have a depth of 120 mm so that the straws extend out of these test-tubes by 13 mm. Consequently, bearing in mind that the drum 21 and consequently the test-tubes 7 are disposed substantially adjacent the shifting device 11 comprising the bar 26, the straws already contained in the test-tube extend out of the latter above this bar 26 and above the straw carried by the bar 26. The straw to be introduced then finds its place, by a rising movement, among the ends of the straws extending out of the test-tube, these straws being urged back to both sides and upwardly by the straw to be introduced and thus surrounding the latter when it terminates its first displacement which brought it to the level of the line X—X, that is to say slightly above the lower level of the test-tube.

Figure 6:
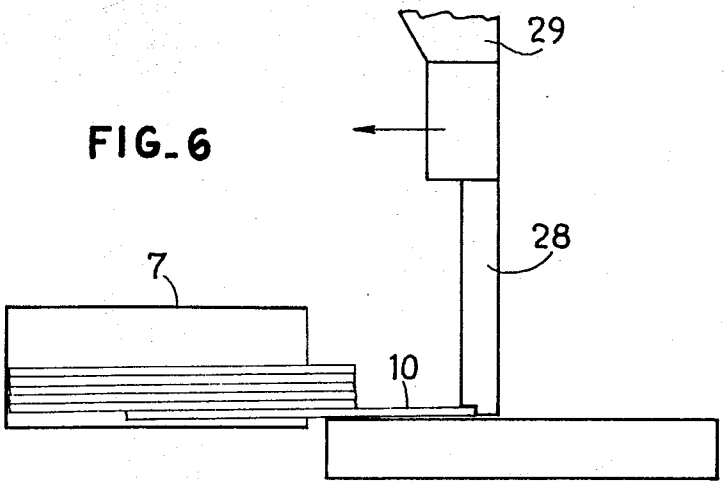

As the carriage 29 is then driven by the disc 35 from the position shown in FIG. 5, the shoulder 39 of the arm 28 then urges the straw to be introduced horizontally into the test-tube 7 among those which are already placed in position, as shown in FIG. 6.

The carriage 29 then returns rearwardly and, as the bar 26 has meanwhile redescended into the passageway 25 so as to receive a new straw 10, the latter is once more raised by this bar 26 and then introduced by the arm 28 into the test-tube and so on.

The counter 36 has information input means whereby the operator can indicate the number of straws to be introduced into each test-tube. When the number of displacements of the carriage 29 counted by the counter 36 reaches the information or desired value, this counter causes through the transmission 37 the rotation of the drum 21 which discharges the test-tube that has been filled with the required number of straws, the following recess placing in position a new test-tube at the filling station 8 and the same operation is effected on this new test-tube. It is also possible to provide on the counter 36 input means for indicating the desired total number of straws to be placed in position in the course of one cycle of operation of the appratus or, which amounts to the same thing, the desired number of test-tubes to be charged. When the total number of straws counted reaches this second fixed number, the counter stops the motor 16 and consequently the whole of the apparatus.

If it should happen that a test-tube be introduced the wrong way round, in order to preclude the straws, which have a high value, from abutting against the end of this test-tube and breaking under the force exerted by the arm 28, the latter can retract rearwardly in opposition to the action of the calibrated spring 38.

It will be noted that the straws 10 are for example charged directly in the hopper 9 practically without leaving the level of the grid 4 or cold zone owing to the use of tongs which are introduced in the vessel for seizing large-size storage test-tubes 7*a* which are placed on the grid 4 and are emptied into the hopper 9 by means of the tongs. Thus it can be seen that all of the handling operations on the straws take place in the cold zone of the vessel which ensures their maximum conservation.

It will be understood that the straws aligned one after the other may be grouped in cases or sheaths of great length which have a section slightly greater than that of a straw.

Having now described my invention, what I claim as new and desire to secure by Letters Patent is:

1. An apparatus for grouping artificial insemination straws in a container whose length is less than the length of the straws, comprising in combination a support means and, mounted on said support means: a filling station, a device for feeding containers one by one to the filling station, each of said containers having at said filling station a filling opening substantially contained in a plane which is substantially vertical, a device for feeding the straws one by one to a charging position in which the straw is substantially horizontal and substantially perpendicular to said plane, said filling station having a space which is divided by said plane into a first space part and a second space part, the container being located in said first space part and the straw being located in said second space part at said filling station, a charging device for shifting the straws one by one in a direction parallel to the direction of the length of the straw from said charging position to a charged position inside the container, and said straw feeding device comprising a straw supply means for supplying straws one by one to a substantially horizontal intermediate position in which the straw is oriented in a direction substantially parallel to said charging position but below the level of the lowermost part of the opening of the container, and an intermediate shifting device for shifting the straws one by one in a direction transverse to the length of the straw from said intermediate position to said charging position which charging position is disposed above said level and intersects the position of the lowermost straw in the container.

2. An apparatus as claimed in claim 1, wherein the charging device comprises thrust means having a substantially horizontal travel longitudinally of the straws in said charging position.

3. An apparatus as claimed in claim 1, wherein the intermeduate shifting device comprises a raising means having a substantially vertical travel.

4. An apparatus as claimed in claim 1, wherein the container feeding device comprises container supply means having an outlet, a drum rotatable about a horizontal axis and defining on its periphery a number of recesses each of which recesses is capable of coming in front of the container supply means outlet at said filling station for engaging the containers one at a time and holding the engaged container in position for charging straws therein.

5. An apparatus as claimed in claim 1, comprising a device for counting the number of straws charged into the container and actuating the container feed device each time the required number of straws has been charged into the container.

6. An apparatus for mounting on a storage vessel and grouping artificial insemination straws in a container, comprising in combination a chassis for mounting on the storage vessel and, mounted on said chassis: a filling station, a device for feeding containers one by one to the filling station, each of said containers having at said filling station a filling opening substantially contained in a plane which is substantially vertical, a device for feeding the straws one by one to a charging position in which the straw is substantially horizontal and substantially perpendicular to said plane, said filling station having a space which is divided by said plane into a first space part and a second space part, the container being located in said first space part and the straw being located in said second space part at said filling station, a charging device for shifting the straws one by one in a direction parallel to the direction of the length of the straw from said charging position to a charged position inside the container, drive means, and transmission means between said drive means and said container feeding device, said straw feeding device and said charging device, said charging device comprising thrust means having a substantially horizontal travel longitudinally of the straws in said charging position, a movable carriage, means for guiding the carriage substantially horizontally relative to the chassis, and an arm extending downwardly from and carried by the carriage and having an end portion for engaging an end of the straw in said charging position.

7. An apparatus as claimed in claim 6, wherein the charging device comprises a rotatable disc which has a horizontal axis of rotation and is connected to be driven in rotation by the drive means, a pin carried by the disc and a substantially vertical slideway integral with said carriage and engaged by the pin for shifting said carriage.

8. An apparatus as claimed in claim 6, wherein said arm is mounted on said carriage to pivot about a substantially horizontal axis and is maintained in an operative position for engaging an end of the straw by elastically yieldable means.

9. An apparatus for mounting on a storage vessel and grouping artificial insemination straws in a container whose length is less than the length of the straws, said apparatus comprising in combination a chassis for mounting on the storage vessel and, mounted on said chassis: a filling station, a device for feeding containers one by one to the filling station, each of said containers having at said filling station a filling opening substantially contained in a plane which is substantially vertical, a device for feeding the straws one by one to a charging position in which the straw is substantially horizontal and substantially perpendicular to said plane, said filling station having a space which is divided by said plane into a first space part and a second space part, the container being located in said first space part and the straw being located in said second space part at said filling station, a charging device for shifting the straws one by one in a direction parallel to the direction of the length of the straw from said charging position to a charged position inside the container, drive means and transmission means between said drive means and said container feeding device, said straw feeding device and said charging device, said straw feeding device comprising a straw supply means for supplying straws one by one to a substantially horizontal intermediate position in which the straw is oriented in a direction substantially parallel to said charging position but below the level of the lowermost part of the opening of the container, and an intermediate shifting device for shifting the straws one by one in a direction transverse to the length of the straw from said intermediate position to said charging position which charging position is disposed above said level and intersects the position of the lowermost straw in the container, said intermediate shifting means defining a first passageway having a width corresponding to the width of a straw for guiding the straws upwardly transversely of the straws from said intermediate position, a substantially horizontal bar upwardly slidable in the said passageway between said intermediate position and said charging position, a hopper for straws, means defining a second passageway extending from the hopper for guiding the straws from the hopper transversely of the straws and having a width corresponding to the width of the straws and an outlet extending in a direction substantially parallel to the straws in the second passageway, said outlet opening onto said first passageway in said intermediate position whereby said bar can shift the straws one by one transversely of the straws from said outlet of said second passage to said charging position.

10. The combination comprising a cryogenic vessel having an open upper end and containing a freezing fluid up to a given level in the vessel, and an apparatus for grouping artificial insemination straws in containers, the apparatus comprising in combination a chassis bearing on said upper open end and, suspended from said chassis: a filling station, a device for feeding containers one by one to the filling station, each of said containers having at said filling station a filling opening substantially contained in a plane which is substantially vertical, a device for feeding the straws one by one to a charging position in which the straw is substantially horizontal and substantially perpendicular to said plane, said filling station having a space which is divided by said plane into a first space part and a second space part, the container being located in said first space part and the straw being located in said second space part at said filling station, a charging device for shifting the straws one by one in a direction parallel to the direction of the length of the straw from said charging position to a charged position inside the container.

11. The combination comprising a cryogenic vessel having an open upper end and containing a freezing fluid up to a given level in the vessel, and an apparatus for grouping artificial insemination straws in containers, the apparatus comprising in combination a chassis bearing on said upper open end and, suspended from said chassis: a filling station, a device for feeding containers one-by-one to the filling station, each of said containers having at said filling station a filling opening substantially contained in a plane which is substantially vertical, a device for feeding the straws one by one to a charging position in which the straw is substantially horizontal and substantially perpendicular to said plane, said filling station having a space which is divided by said plane into a first space part and a second space part, the container being located in said first space part and the straw being located in said second space part at said filling station, a charging device for shifting the straws one by one in a direction parallel to the direction of the length of the straw from said charging position to a charged position inside the container, drive means and transmission means connecting said drive means to said container feeding device, said straw feeding device and said charging device, said container feeding device, straw feeding device and charging device being located just above said level of said freezing fluid.

* * * * *